United States Patent [19]

Kawazoe et al.

[11] Patent Number: 5,062,948

[45] Date of Patent: Nov. 5, 1991

[54] MERCURY REMOVAL FROM LIQUID HYDROCARBON COMPOUND

[75] Inventors: Tetsu Kawazoe; Tsukasa Iida, both of Ichihara, Japan

[73] Assignee: Mitsui Petrochemical Industries, Ltd., Tokyo, Japan

[21] Appl. No.: 486,607

[22] Filed: Feb. 28, 1990

[30] Foreign Application Priority Data

Mar. 3, 1989 [JP] Japan ..... 1-51685

[51] Int. Cl.[5] ..... C10G 17/00

[52] U.S. Cl. ..... 208/251 R; 208/187; 208/299; 208/301; 208/302; 208/303; 208/349; 208/354; 585/802; 585/807; 585/820; 585/822

[58] Field of Search ..... 208/251 R, 303, 349, 208/354; 585/802, 807, 820, 822

[56] References Cited

U.S. PATENT DOCUMENTS 4,473,461 9/1984 Thacker et al. ..... 208/251 R
4,709,118 11/1987 Yan ..... 585/820
4,909,926 3/1990 Yan ..... 208/251 R
4,946,582 8/1990 Torihata et al. ..... 208/251 R

FOREIGN PATENT DOCUMENTS 0325486 7/1989 European Pat. Off. .

*Primary Examiner*—Helane E. Myers
*Attorney, Agent, or Firm*—Birch, Stewart, Kolasch & Birch

[57] ABSTRACT

The invention provides a method for removing mercury from a liquid hydrocarbon feed material by (a) removing those components having a higher molecular weight than the desired hydrocarbon from the feed material, (b) removing water from the feed material, and thereafter (c) removing mercury from the feed material. Mercury can be removed to an extremely low concentration of 0.001 ppm or lower from a wide variety of liquid hydrocarbon feed materials containing either a relatively large amount or a trace amount of mercury.

16 Claims, 1 Drawing Sheet

MERCURY REMOVAL FROM LIQUID HYDROCARBON COMPOUND

CROSS-REFERENCE TO THE RELATED APPLICATION

This application is related to copending application Ser. No. 299,025 filed on Jan. 19, 1989 now U.S. Pat. No. 4,946,582, by TAKASHI TORIHARA for "METHOD OF REMOVING MERCURY FROM HYDROCARBON OILS".

BACKGROUND OF THE INVENTION

1. Field of the Invention

This invention relates to a method for removing mercury from a hydrocarbon compound which contains a small amount of mercury and can be handled in a liquid state on a commercial scale (to be referred to as "liquid hydrocarbon compound" hereinafter).

2. Description of Related Art

In the prior art, mercury removal techniques were developed and established as one of the pollution control measures in order to remove toxic mercury from exhausted gases. A variety of techniques were available in the prior art for removing mercury from water and gases.

Palladium-carrying alumina and similar catalysts are often used in modifying a liquid hydrocarbon compound through hydrogenation or the like. It is known that, if mercury is present in the hydrocarbon compound as an incidental impurity, the catalyst is poisoned such that modification may not fully take place.

For removal of mercury from a liquid hydrocarbon compound, there are currently available no techniques which can be practiced on a commercial large scale at a reasonable cost. For example, Japanese Patent Application Kokai No. 90502/1977 discloses a method for removing mercury from vacuum pump oil by adding zinc sulfide to the oil, allowing the zinc sulfide to adsorb and collect mercury, and thereafter separating the mercury along with the excess zinc sulfide. This mercury removal results in a vacuum pump oil having a mercury concentration of about 5 to 3 parts by weight per million parts by volume, but this mercury removal is still insufficient for the object contemplated in the present invention.

SUMMARY OF THE INVENTION

An object of the invention is to provide a commercially applicable method for removing mercury from a liquid hydrocarbon compound containing an amount of mercury whereby mercury is removed to an extremely low concentration of 0.001 ppm or lower.

According to the present invention, there is provided a method for removing mercury from a liquid hydrocarbon compound which contains some water and components having a higher molecular weight than the desired hydrocarbon compound along with mercury, comprising the steps of: (a) removing the higher molecular weight components from the hydrocarbon compound, (b) removing water from the hydrocarbon compound, and thereafter (c) removing mercury from the hydrocarbon compound.

Preferably, the mercury removing step (c) includes contacting the liquid hydrocarbon compound with an adsorbent having an active component supported on a carrier. The active component is selected from the group consisting of copper compounds, tin compounds, and mixtures thereof, and the carrier is selected from the group consisting of active carbon, activated clay, silica gel, zeolite, molecular sieve, alumina, silica, silica-alumina, and mixtures thereof.

Also preferably, the mercury removing step (c) includes contacting the liquid hydrocarbon compound with an adsorbent having an active component added to active carbon. The active component is selected from the group consisting of the elements of Groups III to VIII in the Periodic Table, chelate compounds, and mixtures thereof.

DETAILED DESCRIPTION OF THE INVENTION

Figure 1:
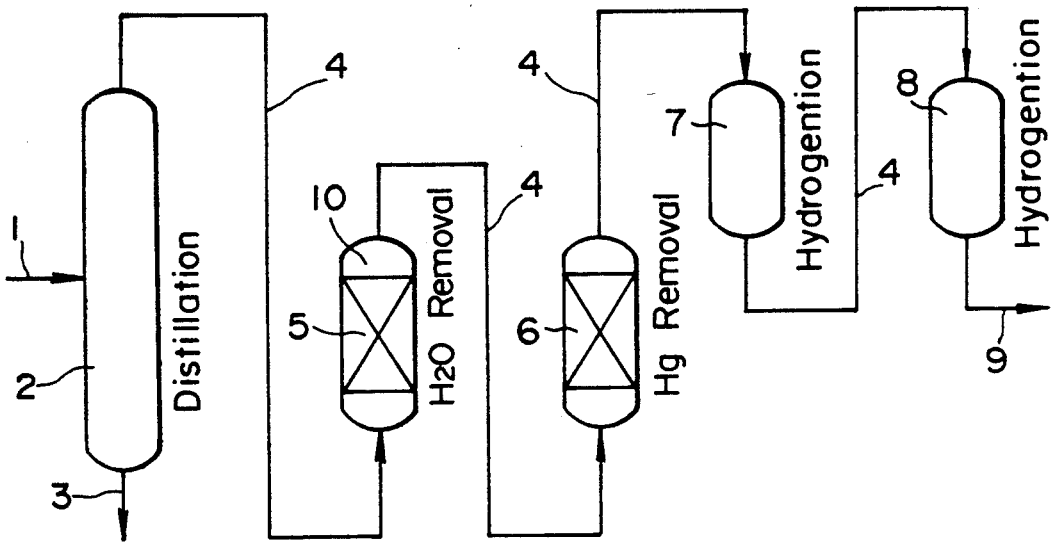
FIG. 1 schematically illustrates the mercury removal method according to the invention.

The liquid hydrocarbon compound to which the method of the invention is applicable may be selected from hydrocarbon compounds derived from liquefied natural gases, petroleum and coal as long as it can be handled in a liquid state on a commercial scale. When the hydrocarbon is a low boiling compound such as ethylene and propylene, it may be processed under a sufficient pressure to maintain it in a liquid state. When the hydrocarbon is a high boiling compound which is liquid at approximately room temperature and atmospheric pressure, for example, in the case of crude oils, straight run naphtha, kerosene, gas oil, and the like, it may be processed at such temperatures and pressures. Even when the hydrocarbon is a compound which is solid at room temperature, it may be processed if it could be maintained in a liquid state by means of heating. Preferably, a hydrocarbon compound having not more than 5 carbon atoms, which is gas at room temperature under atmospheric pressure, may be converted into a liquid state and applied to the method of the present invention, because such an application renders possible simple operation with a high ratio of mercury removal. Especially, processing of liquefied natural gas (LNG), liquefied petroleum gas (LPG) and a liquefied olefin having not more than 5 carbon atoms, such as liquefied ethylene and liquefied propylene, has high commercial value.

The hydrocarbon compound used herein encompasses a hydrocarbon compound alone and a mixture of hydrocarbon compounds.

The hydrocarbon compound is usually available as containing some amount of water and higher molecular weight components as impurities. Also the hydrocarbon compound contains a contaminant in the form of mercury in elemental, inorganic or organic form. The concentration of mercury in the hydrocarbon compound is not critical. The present mercury removal method is applicable to both a hydrocarbon compound feed material containing a relatively large amount of mercury and a hydrocarbon compound feed material containing a trace amount of mercury. In either case, mercury can be removed to an extremely low concentration. Most often, the present mercury removal method is applied to hydrocarbon compounds containing about 0.002 to 10 ppm of mercury.

One feature of the present mercury removal method is to effect (a) removal of higher molecular weight components and (b) removal of water prior to (c) mercury removal.

Steps (a) and (b) may be carried out either simultaneously or separately. In the latter case, either step (a) or (b) ;may be the first step.

In water removal step (b), water is preferably removed to such an extent as to provide a water concentration of up to its solubility, provided that there is substantially absent free water.

Step (a) is to remove those components having a higher molecular weight than the desired hydrocarbon from the starting liquid hydrocarbon compound. The higher molecular weight components are not particularly limited and they generally include those components having a higher molecular weight than the desired hydrocarbon(s).

For commercial scale processing, where the desired product is a low boiling compound having 2 to 4 carbon atoms, higher molecular weight components having 5 or more carbon atoms are removed. Similarly, where the desired product is a moderate boiling compound having 6 to 8 carbon atoms, higher molecular weight components having 9 or more carbon atoms are removed.

Where the desired hydrocarbon is, for example, a hydrocarbon having 3 carbon atoms, the higher molecular weight components having 4 or more carbon atoms are preferably removed to a level of 1 mol % or lower.

Removal in steps (a) and (b) may be effected by distillation, filtration, adsorption to molecular sieves, and adsorption to zeolite although the removal means is not limited thereto.

The steps of (a) removal of higher molecular weight components and (b) removal of water taken prior to (c) mercury removal make it possible for step (c) to remove mercury to a desired extremely low level of about 0.001 ppm or lower while maintaining the performance of associated mercury removing equipment such as an adsorption column over a commercially acceptable long period of time and using an economically acceptable small amount of adsorbent.

Mercury removal step (c) is not particularly limited. Any well-known adsorbents may be employed.

Although platinum group elements (Ru, Rh, Pd, Os, Ir and Pt) and Au, Ag and Ni on supports such as active carbon and alumina can be used as the adsorbent in mercury removal step (c) of the present method, these adsorbents are generally too expensive for commercial application. It might occur to those skilled in the art to regenerate these adsorbents for their economic use by passing high temperature gases therethrough. However, the outflow of high temperature gases which have been used for regeneration naturally contains mercury vapor and thus requires installation of an additional mercury removal equipment for atmospheric pollution control.

For these and other reasons, step (c) favors mercury removal through solid-liquid contact adsorption using adsorbents to be described below.

(1) Copper

A liquid hydrocarbon compound containing mercury is contacted with an adsorbent having copper and/or a copper compound supported on a carrier selected from the group consisting of active carbon, activated clay, silica gel, zeolite, molecular sieve, alumina, silica, silica-alumina, and mixtures thereof.

The active carbon used herein may be commonly used granular or powder active carbon. Steam activated carbon is also useful. Preferred active carbon has a pore size of 10 to 500 Å, especially 10 to 100 Å and a specific surface area of 100 to 1,500 $m^2/g$, especially 800 to 1,200 $m^2/g$. Active carbon having physical dimensions within these ranges can more efficiently remove mercury.

Copper and/or a copper compound is preferably supported on active carbon in an amount of about 0.1 to 30% by weight based on the weight of the carrier or active carbon.

The carriers activated clay, silica gel, zeolite, molecular sieve, alumina, silica, and silica-alumina. Preferred carriers have a specific surface area of at least 100 $m^2/g$, especially 100 to 1,500 $m^2/g$. Carriers having physical dimensions within this range can more efficiently remove mercury. Preferably, the carrier has been treated with an acid.

Copper and/or a copper compound is preferably supported on the carrier in an amount of about 0.1 to 30% by weight based on the weight of the carrier.

The copper and/or a copper compound supported on the carriers include elemental copper, copper compounds, and mixtures thereof. It is believed that copper and copper compounds are present on the carrier in elemental copper, ionic copper, copper compound or solvate form although the invention is not bound to the theory. For the purpose of invention, it is sufficient to describe that copper or a copper compound is supported on a carrier.

Preferably, the copper compound is selected from copper halides and copper oxides.

Preferred copper halides include CuCl and $CuCl_2$, with cupric chloride being most preferred. A copper-carrying adsorbent may be prepared by dissolving a copper halide in an inorganic solvent such as water, hydrochloric acid solution, alkali chloride solution, and aqueous ammonia or an organic solvent such as acetone and alcohol, dipping a carrier in the solution, evaporating the solvent using an evaporator, drying and sintering the carrier.

Another preferred copper compound is copper oxide. A copper oxide-carrying adsorbent may be prepared by dipping a porous carrier in a copper solution, drying the carrier as described above, and sintering the carrier in an oxygen atmosphere.

(2) Tin

A liquid hydrocarbon compound containing mercury is contacted with an adsorbent having tin and/or a tin compound supported on a carrier selected from the group consisting of active carbon, activated clay, silica gel, zeolite, molecular sieve, alumina, silica, silica-alumina, and mixtures thereof.

The active carbon, activated clay, silica gel, zeolite molecular sieve, alumina, silica, and silica-alumina used as the carrier are the same as described in (1).

Tin and/or a tin compound is preferably supported on the carrier in an amount of about 0.1 to 30% by weight based on the weight of the carrier.

The tin and/or a tin compound is preferably supported on the carrier in an amount of about 0.1 to 30% by weight based on the weight of the carrier.

The tin and tin compounds supported on the carriers include elemental tin, tin compounds, tin ions, and mixtures thereof. It is believed that tin and tin compounds are present on the carrier in elemental tin, ionic tin, tin compound or solvate form although the invention is not bound to the theory. For the purpose of invention, it si sufficient to describe that tin or a tin compound is supported on a carrier.

Preferably, the tin compound is selected from tin halides and tin oxides.

Preferred tin halides include $SnCl_2$, and $SnCl_4$, with stannous chloride being most preferred. A tin-carrying adsorbent may be prepared by dissolving a tin halide in an inorganic solvent such as water, hydrochloric acid solution, and alkali solution or an organic solvent such as acetone and alcohol, dipping a porous carrier in the solution, evaporating the solvent using an evaporator, drying and sintering the carrier.

Another preferred tin compound is tin oxide. A tin oxide-carrying adsorbent may be prepared by dipping a porous carrier in a tin solution, drying the carrier as described above, and sintering the carrier in an oxygen atmosphere.

(3) Group III to VIII element and chelate compound

A liquid hydrocarbon compound containing mercury is contacted with an adsorbent having an element of Groups III to VIII in the Periodic Table and/or a chelate compound added to active carbon.

The elements of Groups III to VIII in the Periodic Table include Al, S, Sb, In, Cr, Co, Sn, Ti, Fe, Pb, Ni, V, and Mn. The chelate compounds are metal chelate compounds, preferably metal chelated polymers. The ligands which form metal chelate compounds preferably have N and/or S as a donor atom.

The active carbon which supports the Group III to VIII element or chelate compound may be commonly used active carbon, especially coconut shell carbon.

In the practice of the present invention, it has been found that some commercially available gas-phase mercury removing adsorbents which were believed in the prior art to be inapplicable to hydrocarbon compounds in the liquid phase can be used because water and higher molecular weight components have been removed from a hydrocarbon compound. Examples of these commercially available adsorbents which can be used herein include active carbon having sulfur attached thereto, active carbon having N and S coordination chelate compounds attached thereto, and active carbon having tin or a tin compound attached thereto. Among them, an adsorbent having a specific surface area of 200 to 900 $m^2/g$ is desirable. These adsorbents are commercially available under trade names of ALM-G from Nihon Soda K.K., MA-G from Hokuetsu Carbon Industry K.K., and HGR from Toyo Calgon K.K.

The necessary amount of active component in the adsorbent varies with the desired ;mercury concentration in the output, the replacing frequency of the adsorbent, and a particular type of adsorbent. Where the liquid hydrocarbon compound from which water and higher molecular weight components have been removed contains mercury in a concentration of 0.01 ppm on weight basis, the amount of active component in the adsorbent generally ranges from 10 to 1000 grams per gram of mercury being removed.

The adsorbent is often used in a fixed bed adsorbing column. Usually, the liquid hydrocarbon compound is passed through a drum which is packed with adsorbent granules of 4 to 80 mesh.

The mercury removing equipment used in step (c) of the present method may be a fixed bed adsorption column in a single column system, an alternate double column system, a series double column system, or a parallel, series or alternate system of two or more columns. Most often, the liquid is continuously fed through a fixed bed adsorption column. In addition to the fixed bed, a moving bed, a fluidized bed or other bed forms may be employed. A particular bed may be selected by taking into account the mercury concentration of the feed material, the difference between the initial and final mercury concentrations, and replacement of the adsorbent.

The operating temperature generally ranges from 10° to 150° C., preferably from 20° to 100° C. The operating pressure generally ranges from atmospheric pressure to 100 $kgf/cm^2G$, preferably from atmospheric pressure to 30 $kgf/cm^2G$. The average residence time of the liquid in the adsorption equipment generally ranges from 45 to 1,200 seconds, preferably from 90 to 360 seconds. The linear velocity of the liquid through the adsorption equipment generally ranges from 0.001 to 0.1 m/sec., preferably from 0.01 to 0.1 m/sec. The LHSV generally ranges from 80 to 3 $hr^{-1}$, preferably 40 to 10 $hr^{-1}$.

Referring to FIG. 1, there is schematically illustrated one embodiment of the present method as applied to mercury removal from a petroleum fraction having 3 carbon atoms ($C_3$fraction). The flow system illustrated includes a distillation column 2, a dehydrating drum 5, a fixed bed drum 6 for mercury removal, a first drum 7 for hydrogenation, and a second drum 8 for hydrogenation, connected through a feed line 4 in a series flow arrangement.

An inlet line 1 is connected to the distillation column 2 at a center thereof for feeding a liquid hydrocarbon feed material containing hydrocarbon components having 3 and 4 or more carbon atoms. A line 3 is connected to the bottom of the distillation column 2 for discharging higher molecular weight components. The feed line 4 is connected top the top of the column 2. The liquid feed material is subject to distillation in the column 2 whereupon the higher molecular weight components, that is, $C_4$ or more higher hydrocarbon components are discharged through the discharge line 3. The distilled fraction, that is, the desired $C_3$ hydrocarbon component is fed from the column 2 to the dehydrating drum 5 through the feed line 4. Since the dehydrating drum 5 is equipped with a zeolite fixed bed column, the zeolite removes water from the $C_3$ fraction during its passage through the column. The dehydrated feed material (or $C_3$ fraction) is then fed from the dehydrating drum 5 at its top to the mercury removal drum 6 at its bottom through the feed line 4. Since the drum 6 is equipped with a fixed bed of a mercury removing adsorbent, mercury is adsorbed and removed from the liquid feed material (or $C_3$ fraction).

The liquid hydrocarbon compound from which mercury has been removed in this way is then transferred to the first and second drums 7 and 8 through the feed line 4 whereby the hydrocarbon is subject to hydrogenation or similar reaction. The thus treated material is then delivered as a final product to an outlet line 9.

EXAMPLE

Examples of the present invention are given below by way of illustration and not by way of limitation. In the examples, ppm is parts by weight per million parts by weight and ppb is parts by weight per billion parts by weight.

Qualitative test

Figure 2:
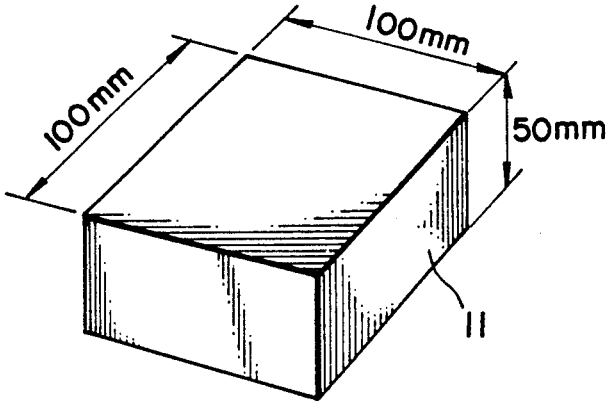
FIG. 2 is a perspective view showing a sample packing container.

There were prepared sample packing containers 11 each of 60 mesh stainless steel having dimensions of 100×100×50 mm as shown in FIG. 2. The containers 11 were packed with the mercury removing adsorbents shown in Table 1. The adsorbent packed containers 11 were placed in a test region 10 within the dehydrating drum 5 near its top as shown in FIG. 1. The feed material fed to the distillation column 2 was a liquid hydrocarbon feed material containing a major amount of $C_3$ hydrocarbon component, a minor amount of $C_4$ or more higher hydrocarbon components, some water and a trace amount of mercury. The $C_4$ and higher components were removed from the feed material in the distillation column 2. The feed material was dehydrated in the column 5. At this point, the feed material contained 0.006 ppm of mercury, 40 ppm of the higher molecular weight components ($C_4$ and higher components), and 12 ppm of water. The feed material was then passed through the adsorbent packed containers, in order to find qualitative tendency of the mercury removing effect. The conditions included a temperature of 10° C., a pressure of 10 kgf/cm$^2$G, a residence time of 4.4 sec. and an LHSV of 811 hr$^{-1}$. At the end of the operation, the weight of the adsorbent was measured to determine the weight of mercury adsorbed thereto. The results are shown in Table 1.

TABLE 1

| | Candidate adsorbents tested | | Hg in adsorbent | |
|---|---|---|---|---|
| | Abbr. | Manufacturer and material | (wt ppm) | Rating |
| Comparison | CAL | Toyo Calgon Active carbon | <10 | Poor |
| Invention | MAG | Hokuetsu Carbon, Chelate-added active carbon | 100 | Excellent |
| Comparison | A-3 | Union Showa Molecular sieve, zeolam | <10 | Poor |
| Comparison | A-5 | Union Showa Molecular sieve, zeolam | <10 | Poor |
| Comparison | F-9 | Union Showa Molecular sieve, zeolam | 10 | Poor |
| Comparison | Al Demister | Al amalgam checking use | <10 | Poor |
| Comparison | Catalyst for $C_2$ hydrogenation | Pd catalyst | 20 | Fair |
| Reference | Catalyst for $C_3$ hydrogenation | Pd catalyst | 40 | Fair |
| Invention | Cu-1 | 10 wt % $CuCl_2$ on active carbon* | 80 | Excellent |
| Invention | Cu-2 | 10 wt % $CuCl_2$ on activated clay** | 40 | Good |
| Invention | Sn-1 | 10 wt % $SnCl_2$ on active carbon* | 110 | Excellent |
| Invention | Sn-2 | 10 wt % $SnCl_2$ on activated clay** | 50 | Good |

*Active carbon having a specific surface area of 1050 m$^2$/g, available as CAL (trade name) from Toyo Calgon K.K.

**Activated clay having a specific surface area of 130 m$^2$/g, available as Nikka-Nite 36 (trade name)

EXAMPLES 1-7

A 250-ml column and a 1000-ml column both of which having a diameter of 1.5 inches were packed with each of the adsorbents shown in Table 2. A liquid hydrocarbon feed material consisting essentially of a $C_3$ component was passed through the packed column at a flow rate of 11.3 kg/hour under the processing conditions of a temperature of 10° C. and a pressure of 10 kgf/cm$^2$G. The residence time and LHSV were 42 sec. and 85 hr$^{-1}$, respectively, in the case of the 250-ml column and 168 sec. and 21 hr$^{-1}$ in the case of the 1000-ml column. It should be noted that the liquid $C_3$ hydrocarbon feed material used herein contained 35 ppm of $C_4$ and higher molecular weight components and 5 ppm of water because the higher molecular weight components and water had been removed from the feed material. The results are shown in Table 2.

In all Examples 1 and 2, Reference Example (catalyst for $C_3$ hydrogenation), Examples 3, 4, 5, 6, and 7, no loss of percent mercury removal was observed during the 7-day test (continuous 168-hour test). The percent mercury removal is calculated by the formula:

$$\frac{\text{Hg quantity in inflow} - \text{Hg quantity in outflow}}{\text{Hg quantity in inflow}}$$

COMPARATIVE EXAMPLE 1 and 2

For comparison purposes, liquid $C_3$ hydrocarbon compound feed materials similar to that used in Examples 1-7 were treated.

Comparative Example 1 omitted the removal of higher molecular weight components. That is, $C_4$ and higher molecular weight components were added to the same liquid $C_3$ hydrocarbon compound feed material as in Examples 1-7 such that the material contained 5,000 ppm of $C_4$ and higher molecular weight components. The $C_4$ and higher molecular weight components added were a fuel oil available in the ethylene plant as a by-product.

Comparative Example 2 omitted water removal. That is, water was added to the same liquid $C_3$ hydrocarbon compound feed material as in Examples 1-7 such that the material contained 5,000 ppm of water.

These hydrocarbon compound feed materials were processed using the same adsorbent, HGR (Toyo Calgon K.K.), under the same conditions as in Example 2. The results are also shown in Table 2.

In Comparative Examples 1 and 2, the mercury concentration in the outflow was 4.0 and 3.7 ppb after 24 hours, and 5.4 and 5.0 ppb after 72 hours, indicating a substantial loss of percent mercury removal. Therefore, when water or higher molecular weight components are not removed from the liquid hydrocarbon feed material as in Comparative Examples 1 and 2, the amount of adsorbent packed must be increased or the adsorbent must be frequently replaced so as to compensate for a reduction of percent mercury removal. These two approaches are uneconomical and inadequate for large scale commercial applications.

TABLE 2

| | Adsorbents | | Hg (ppb) in column | | | |
|---|---|---|---|---|---|---|
| | | | | Outlets* | | |
| | Abbr. | Manufacturer and material | Inlet | (A) | (B) | Rating |
| Ex. 1 | ALM-G | Nihon Soda Sn added active carbon | 6 | 2.6 | <1 | Exc. |
| Ex. 2 | HGR | Toyo Calgon S added active carbon | 6 | 3.8 | 1.2 | Good |
| Ref. (Catalyst for $C_3$ hydrogenation) | | Pd-on-alumina | 6 | 3.0 | <1 | Exc. |
| Ex. 3 | MA-G | Hokuetsu Carbon Chelate added active carbon | 6 | 2.4 | <1 | Exc. |
| Ex. 4 | Cu-1 | 10 wt % $CuCl_2$ on active carbon** | 6 | 2.4 | <1 | Exc. |
| Ex. 5 | Cu-2 | 10 wt % $CuCl_2$ on activated clay*** | 6 | 4.5 | 1.9 | Good |
| Ex. 6 | Sn-1 | 10 wt % $SnCl_2$ on active carbon** | 6 | 2.2 | <1 | Exc. |
| Ex. 7 | Sn-2 | 10 wt % $SnCl_2$ on activated clay*** | 6 | 4.0 | 1.2 | Good |
| Comp. Ex. 1 | HGR | Toyo Calgon S added active carbon (higher molecular weight component removal omitted) | 6 | 4.0 (24 hr) 5.4 (72 hr) | not tested | Poor |
| Comp. Ex. 2 | HGR | Toyo Calgon S added active carbon (water removal omitted) | 6 | 3.7 (24 hr) 5.0 (72 hr) | not tested | Poor |

*Outlet (A), 250-ml column; outlet (B), 1000-ml column.
**Active carbon having a specific surface area of 1050 $m^2/g$, available as CAL (trade name) from Toyo Calgon K.K.
***Activated clay having a specific surface area of 130 $m^2/g$, available as Nikka-Nite 36 (trade name)

As seen from Tables 1 and 2, the present method achieves equal or higher mercury removal as compared with the case of the use of the expensive Pd-based catalyst as Hg adsorbent shown in Reference Example.

By removing higher molecular weight components and water from a liquid hydrocarbon compound prior to mercury removal, the present method is successful in removing mercury from the liquid hydrocarbon compound to an extremely low concentration of about 0.001 ppm or lower. The present method is suitable for large scale commercial application.

Although some preferred embodiments have been described, many modifications and variations may be made thereto in the light of the above teachings. It is therefore to be understood that within the scope of the appended claims, the invention may be practiced otherwise than as specifically described.

We claim:

1. A method for removing mercury from a liquid hydrocarbon compound which contains some water, a desired hydrocarbon compound of up to 8 carbon atoms and components having a higher molecular weight than the desired hydrocarbon compound of up to 8 carbon atoms along with mercury, which comprises the steps of:

(a) removing the components having a higher molecular weight than the desired hydrocarbon compound of up to 8 carbon atoms from said compound by distillation, filtration, adsorption by molecular sieves, or adsorption by zeolite, (b) removing water from said compound by distillation, filtration, adsorption by molecular sieves, or adsorption by zeolite, by thereafter (c) contacting the thus obtained compound with an adsorbent having an active component supported on a carrier to remove mercury contained in the thus obtained compound, wherein said steps (a) and (b) are carried out in an arbitrary order.

2. The method of claim 1, wherein in step (c), said active component is selected from the group consisting of copper compounds, tin compounds, and mixtures thereof, and said carrier is selected from the group consisting of active carbon, activated clay, silica gel, zeolite, molecular sieve, alumina, silica, silica-alumina, zinc mixtures thereof.

3. The method of claim 1, wherein the step (c), said active component is selected from the group consisting of the elements of Group III to VIII of the Periodic Table, chelate compounds, and mixtures thereof.

4. The method of claim 1, wherein mercury is removed to a concentration of 0.001 ppm or lower.

5. The method of claim 1, wherein mercury in the initial feed components is present in an amount of 0.002 to 10 ppm of mercury.

6. The method of claim 1, wherein the operating temperature of said method ranges from 10 to 150° C.

7. The method of claim 1, wherein the operating pressure ranges from atmospheric pressure to 100 $kgf/cm^2G$.

8. The method of claim 1, wherein the average residence time of the liquid in absorption equipment ranges from 45 to 1200 seconds.

9. The method of claim 1, wherein the linear variety velocity of the liquid through absorption equipment ranges from 0.001 to 0.1 m/sec.

10. The method of claim 1, wherein the LHSV ranges from 80 to 3 $Hr^{-1}$.

11. The method of claim 1 wherein said active component is selected from the group consisting of halides and oxides of copper and tin, and mixtures thereof.

12. The method of claim 2 wherein said elements of Groups III to VIII in the Periodic Table include Al, S, Sb, In, Cr, Co, Sn, Ti, Fe, Pb, Ni, V, and Mn.

13. The method of claim 3 wherein said chelate compound is a metal chelate compound having N and/or S as a donor atom.

14. A method for removing mercury, which comprises:

(a) providing a liquid hydrocarbon compound which contains water, a desired hydrocarbon compound of up to 8 carbon atoms, and components having a higher molecular weight than the desired hydrocarbon of up to 8 carbon atoms along with mercury, (b) separating said higher molecular weight components from the remaining components, (c) dehydrating the remaining components, (d) removing mercury from the dehydrated components with an absorbent having an active component supported on a carrier, wherein steps (b) and (c) are carried out in an arbitrary order.

15. The method of claim 11, wherein the separating and dehydrating steps (b) and (c) are by distillation, filtration, adsorption by molecular sieves, or absorption by zeolite.

16. The method of claim 11, wherein the mercury to be removed from step (c) has a low boiling point.

* * * * *